US007931261B2

(12) United States Patent
Pangle et al.

(10) Patent No.: US 7,931,261 B2
(45) Date of Patent: Apr. 26, 2011

(54) SIGNATURE HOPPER WITH LAP STRAIGHTENING DEVICE

(75) Inventors: James Aurthur Pangle, Strasburg, VA (US); Glen Roger Caron, Greenland, NH (US); Gary Cooper, Nottingham, NH (US)

(73) Assignee: Goss International Americas, Inc., Durham, NH (US)

( * ) Notice: Subject to any disclaimer, the term of this patent is extended or adjusted under 35 U.S.C. 154(b) by 468 days.

(21) Appl. No.: 11/657,285

(22) Filed: Jan. 24, 2007

(65) Prior Publication Data

US 2007/0170646 A1 Jul. 26, 2007

Related U.S. Application Data

(60) Provisional application No. 60/761,617, filed on Jan. 24, 2006.

(51) Int. Cl.
*B65H 5/08* (2006.01)
*B65H 5/30* (2006.01)

(52) U.S. Cl. ..... 270/52.26; 270/52.2; 270/52.23; 270/52.25; 270/52.16; 270/52.29

(58) Field of Classification Search ..... 270/52.19, 270/52.21, 52.2, 52.22, 52.23, 52.25, 52.26, 270/52.29, 52.16; 271/277
See application file for complete search history.

(56) References Cited

U.S. PATENT DOCUMENTS

| | | | | |
|---|---|---|---|---|
| 1,974,243 | A | 9/1934 | Kleinschmit et al. | |
| 3,089,693 | A | 5/1963 | Gore et al. | |
| 3,371,924 | A | 3/1968 | Nelson | 270/53 |
| 3,809,384 | A | 5/1974 | Zugel | |
| 4,085,927 | A | 4/1978 | Muller | 270/54 |
| 4,180,255 | A | 12/1979 | Himmel | |
| 4,381,106 | A | 4/1983 | Loebach | 270/47 |
| 4,564,186 | A | 1/1986 | Clarke et al. | |
| 4,576,369 | A | 3/1986 | Flensburg | 270/54 |
| 4,844,433 | A | 7/1989 | Hastie | |
| 5,067,700 | A * | 11/1991 | Dick | 270/52.29 |
| 5,100,118 | A * | 3/1992 | Hobbs et al. | 270/52.17 |
| 5,114,129 | A | 5/1992 | Chang et al. | |
| 1,418,865 | A | 6/1992 | Christensen | |
| 5,769,405 | A * | 6/1998 | Glanzmann et al. | 270/52.16 |
| 6,308,945 | B1 | 10/2001 | Sagesser | |

FOREIGN PATENT DOCUMENTS

| | | |
|---|---|---|
| GB | 20 60 578 A | 5/1981 |
| JP | 580 368 61 (A) | 3/1983 |
| JP | 3111375 (A) | 5/1991 |

* cited by examiner

*Primary Examiner* — Leslie A Nicholson, III
(74) *Attorney, Agent, or Firm* — Davidson, Davidson & Kappel, LLC

(57) ABSTRACT

A signature hopper is provided comprising a first drum having a first gripper for a lead edge of a folded signature, a second drum having a second gripper for an open edge of the folded signature, the second gripper having a gripper finger with an end curled in a direction of rotation of the second drum, a dipper blade for pushing the open edge from the first drum toward the second drum so as to contact the gripper finger and a stationary signature guide spaced with respect to the first drum, the signature contacting the signature guide as the first drum rotates the signature past the signature guide.

12 Claims, 7 Drawing Sheets

SIGNATURE HOPPER WITH LAP STRAIGHTENING DEVICE

This application claims priority to U.S. Provisional Application No. 60/761,617 filed Jan. 24, 2006, and hereby incorporated by reference herein.

BACKGROUND OF THE INVENTION

The present invention relates generally to devices for collecting printed products such as a saddle stitcher, gatherer or inserter, and to methods for collecting printed products.

The Goss SP 1000 saddle stitcher for example has a plurality of hoppers which feed signatures to a saddle conveyor. In each hopper, a drum receives folded signatures from a stack and grips the lead or folded edge of the signature. The signature travels around until it hits a fixed register stop, at which time a dipper blade pushes the open edge of the folded signature toward a second drum. The second drum grips the open edge with a gripper and transfers the signature to a further drum which can open the signature for depositing on a saddle conveyor.

BRIEF SUMMARY OF THE INVENTION

When signatures are wrinkled or the lapped end curls, the transfer between the drum and the second drum can fail or have problems.

The present invention provides a signature hopper comprising:

a first drum having a first gripper for a lead edge of a folded signature;

a second drum having a second gripper for an open edge of the folded signature, the second gripper having a gripper finger with an end curled in a direction of rotation of the second drum;

a dipper blade for pushing the open edge from the first drum toward the second drum so as to contact the gripper finger;

a stationary signature guide spaced with respect to the first drum, the signature contacting the signature guide as the first drum rotates the signature past the signature guide.

The dipper blade pushing the open edge against the curled end of the gripper finger permits for excellent transfer of the signatures to the second drum, even if the open edge is curled.

The present invention provides a signature hopper comprising:

a first drum having a first gripper for a lead edge of a folded signature;

a second drum having a second gripper for an open edge of the folded signature;

a dipper blade for pushing the open edge from the first drum toward the second drum;

a register stop for stopping a lead edge of the signature; and a stationary signature guide spaced with respect to the first drum, the signature contacting the signature guide as the first drum rotates the signature past the signature guide, the signature guide having a section concentric with respect to the first drum, the section having an end point in a direction of rotation of the first drum circumferentially spaced from the register stop about the first drum so that the open edge of the signature remains in the signature guide or at the end point when the signature hits the register stop.

By having the signature guide end point be located in this fashion, the signature can be supported right until the dipper blade is actuated.

The end point preferably is circumferentially adjustable.

The present invention provides a signature hopper comprising:

a first drum having a first gripper for a lead edge of a folded signature;

a second drum having a second gripper for an open edge of the folded signature;

a dipper blade for pushing the open edge from the first drum toward the second drum, the dipper blade having a curved profile so as to curve at a blade end opposite a direction of rotation of the first drum;

a stationary signature guide spaced with respect to the first drum, the signature contacting the signature guide as the first drum rotates the signature past the signature guide.

BRIEF DESCRIPTION OF THE DRAWINGS

A preferred embodiment of the present invention is described below by reference to the following drawings, in which.

DETAILED DESCRIPTION OF THE DRAWINGS

Figure 1:
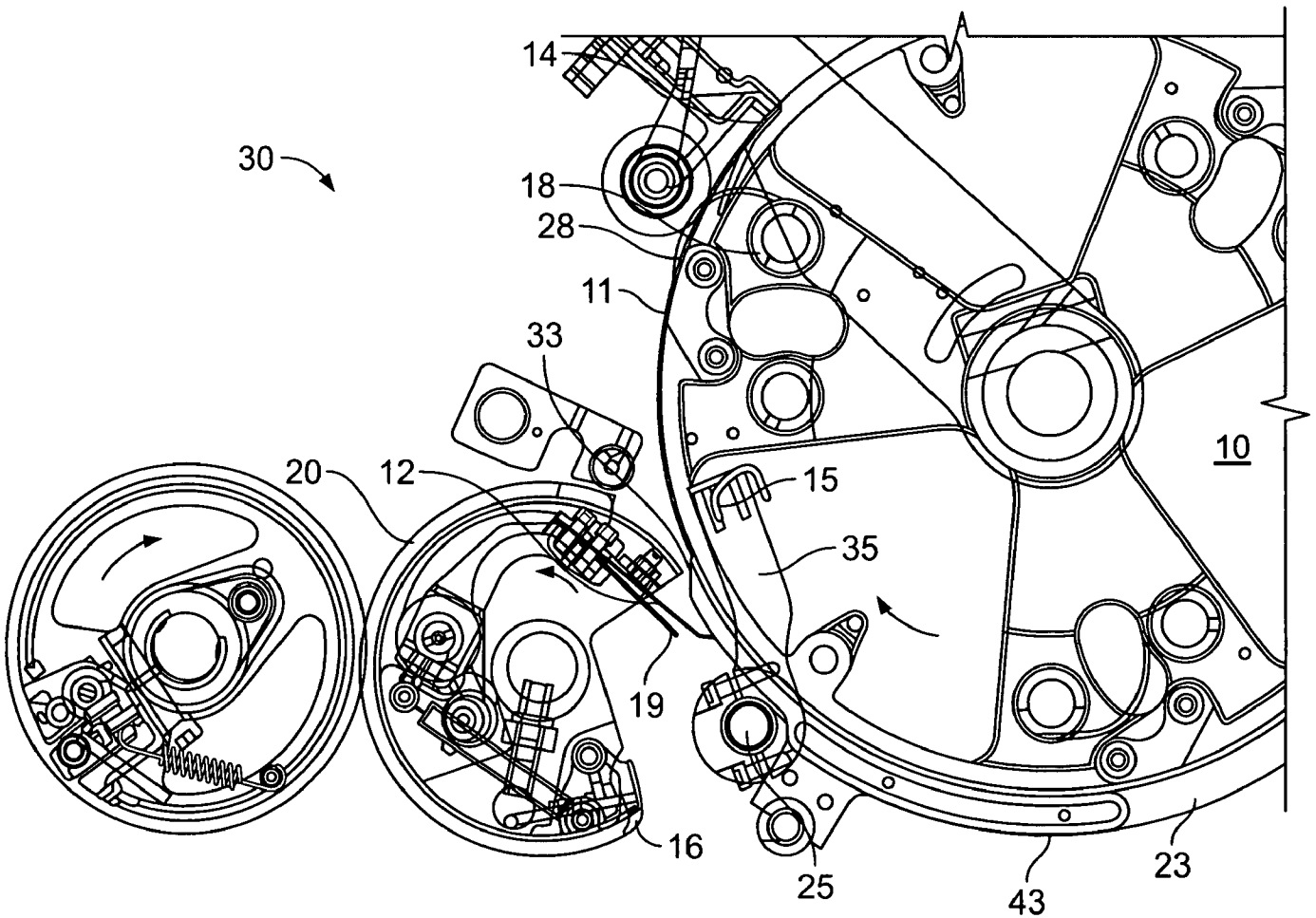
FIG. 1 shows a signature hopper according to the present invention.

FIG. 1 shows a signature hopper 30 having a first drum 10, a second drum 20, a dipper blade 15 and a stationary signature guide with a main section 23 and an extension 43 having an end 33 in a direction of rotation of first drum 10.

First drum 10 includes a plurality of grippers 28 each connected to a support 18, which can rotate to open and close the grippers 28. A stationary register stop 14 for a signature is located next to the first drum 10 and can extend into circumferential grooves in the drum.

Second drum 20 includes a primary gripper 12, a gripper seat 16 and a lap gripper 19. First drum 10 rotates in a clockwise direction while second drum 20 rotates in a counterclockwise direction, as shown.

First drum 10 grips a lead edge of a signature 11 between gripper 28 and an outer surface of the first drum 10 and rotates signature 11 past signature guide 23. Stationary signature guide 23 can smooth out wrinkles in signature 11 and prevent the trailing or open edge from curling away from the outer surface of first drum 10. The trailing edge of signature 11 thus remains between first drum 10 and stationary signature guide 23. Before or when the folded or lead edge of signature 11 hits register stops 14, the grippers 28 open and the signature 11 is prevented from moving further in the direction of rotation of drum 10. Dipper blade 15 at the same time begins to move at least radially with respect to first drum 10. Dipper blade 15 may be cam-activated for example, and rotate about an axis 25 via a support arm 35.

Figure 2:
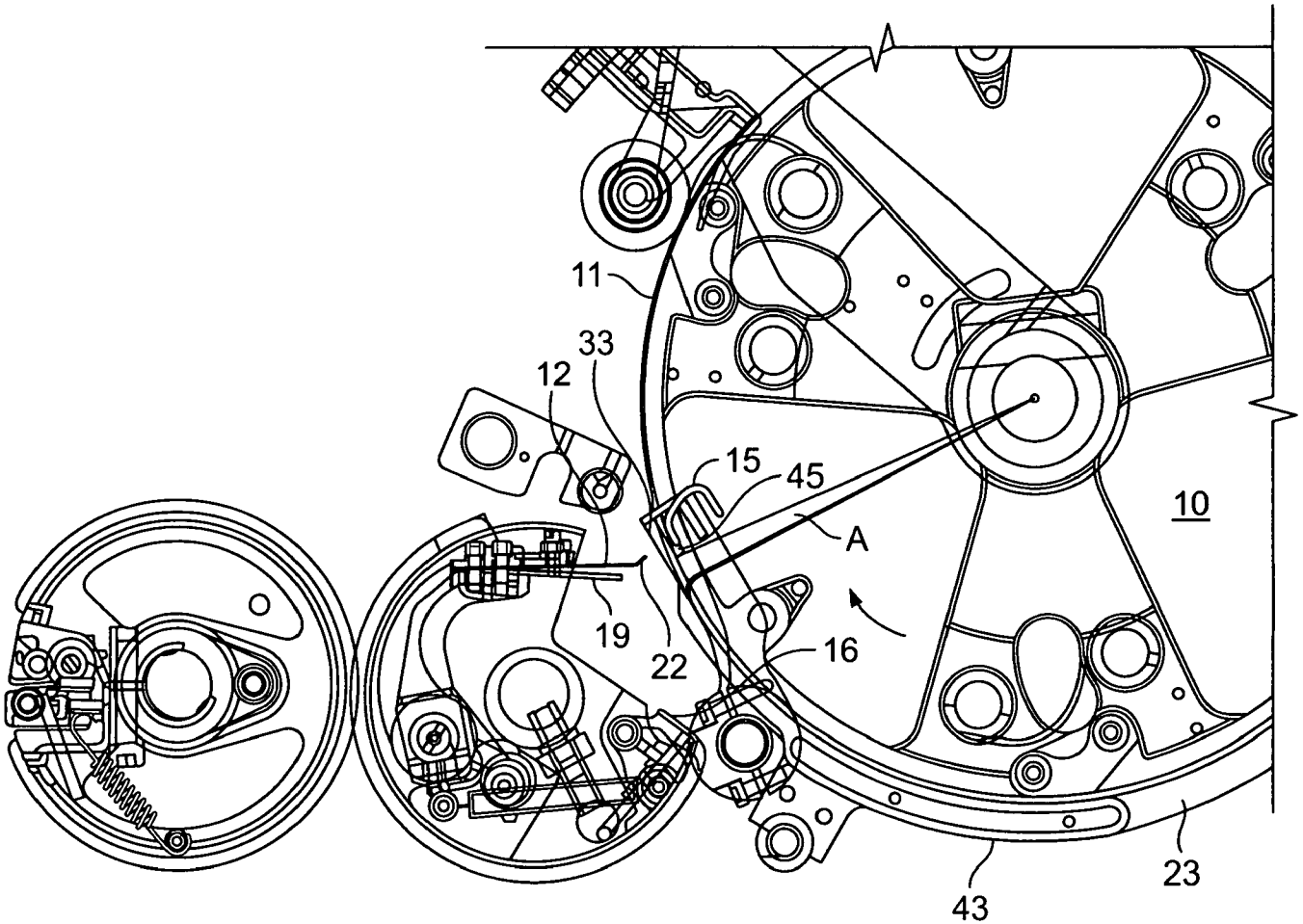
FIG. 2 shows the signature hopper of FIG. 1 with dipper blades contacting a signature.

FIG. 2 shows dipper blade 15 rotating toward signature 11 within a circumferential groove or ends of the first drum 10, and then contacting signature 11. Dipper blade 15 remains in contact with signature 11 until transfer of signature 11 from first drum 10 to the second drum 20 is completed. An angle A represents the distance between an end 45 of the dipper blade 15 opposite the direction of rotation of drum 10 and the stationary signature guide end 33. Angle A is adjustable via the extension 43, which has a slot. Thus, dipper blade 15 contacts signature 11 near the trailing edge of signature 11 at a point where dipper blade 15 does not interfere with stationary signature guide 23. A large portion of dipper blade 15 contacts signature 11 providing adequate signature support, as dipper blade 15 is curved away from the direction of rotation of drum 10.

Figure 3:
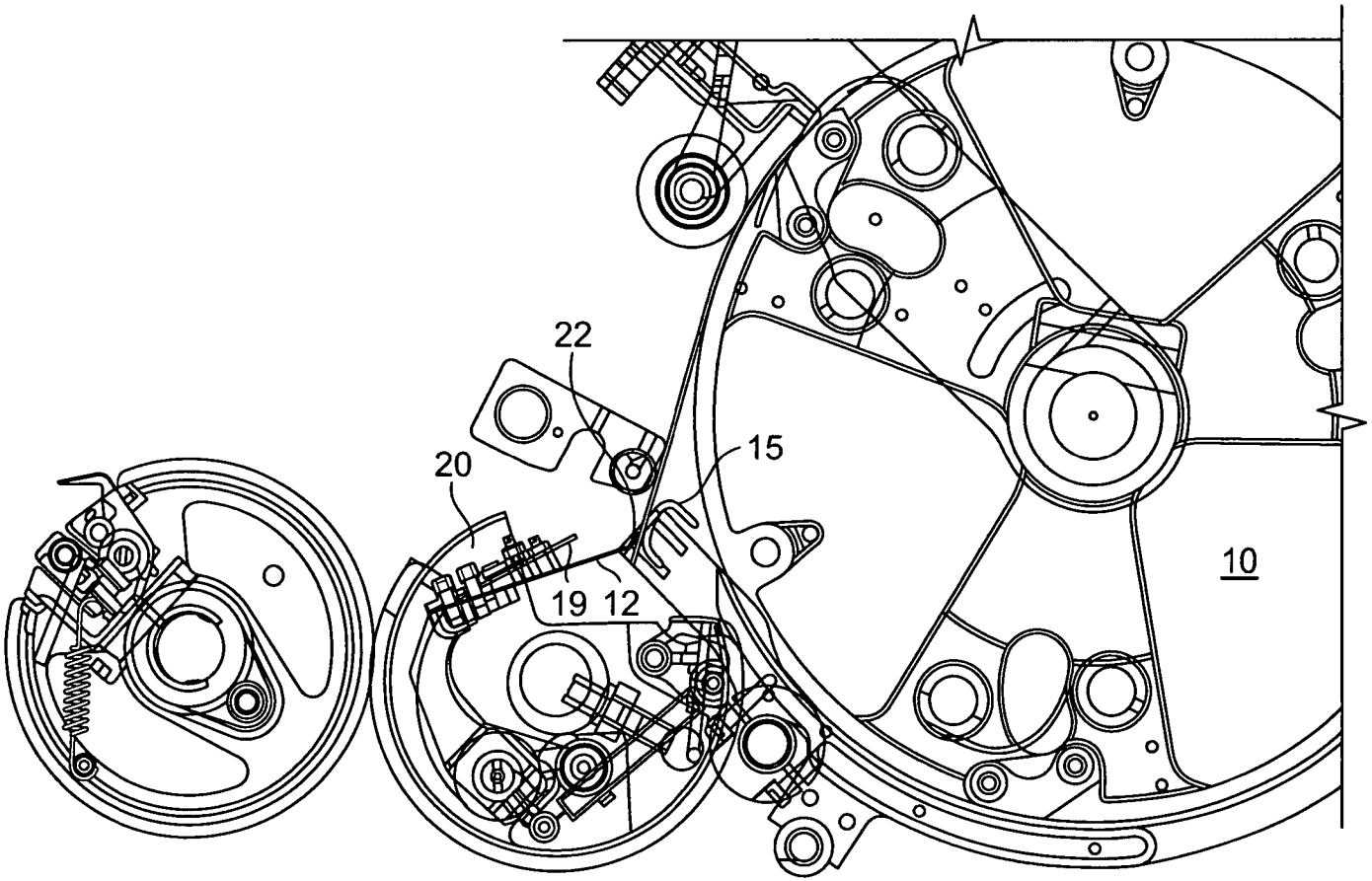
FIG. 3 shows the signature hopper of FIG. 1 with dipper blades forcing the signature against a gripper finger.

FIG. 3 shows dipper blade 15 rotating further away from first drum 10 towards second drum 20 and pushing signature 11 towards second drum 20. Dipper blade 15 remains in contact with signature 11 as first drum 10 continues to rotate. Primary gripper 12 has a curved end 22 which contacts signature 11 as dipper blade 15 pushes signature 11 towards primary gripper 12. Primary gripper 12 begins to close, remaining in contact with signature 11 throughout closing.

Figure 4:
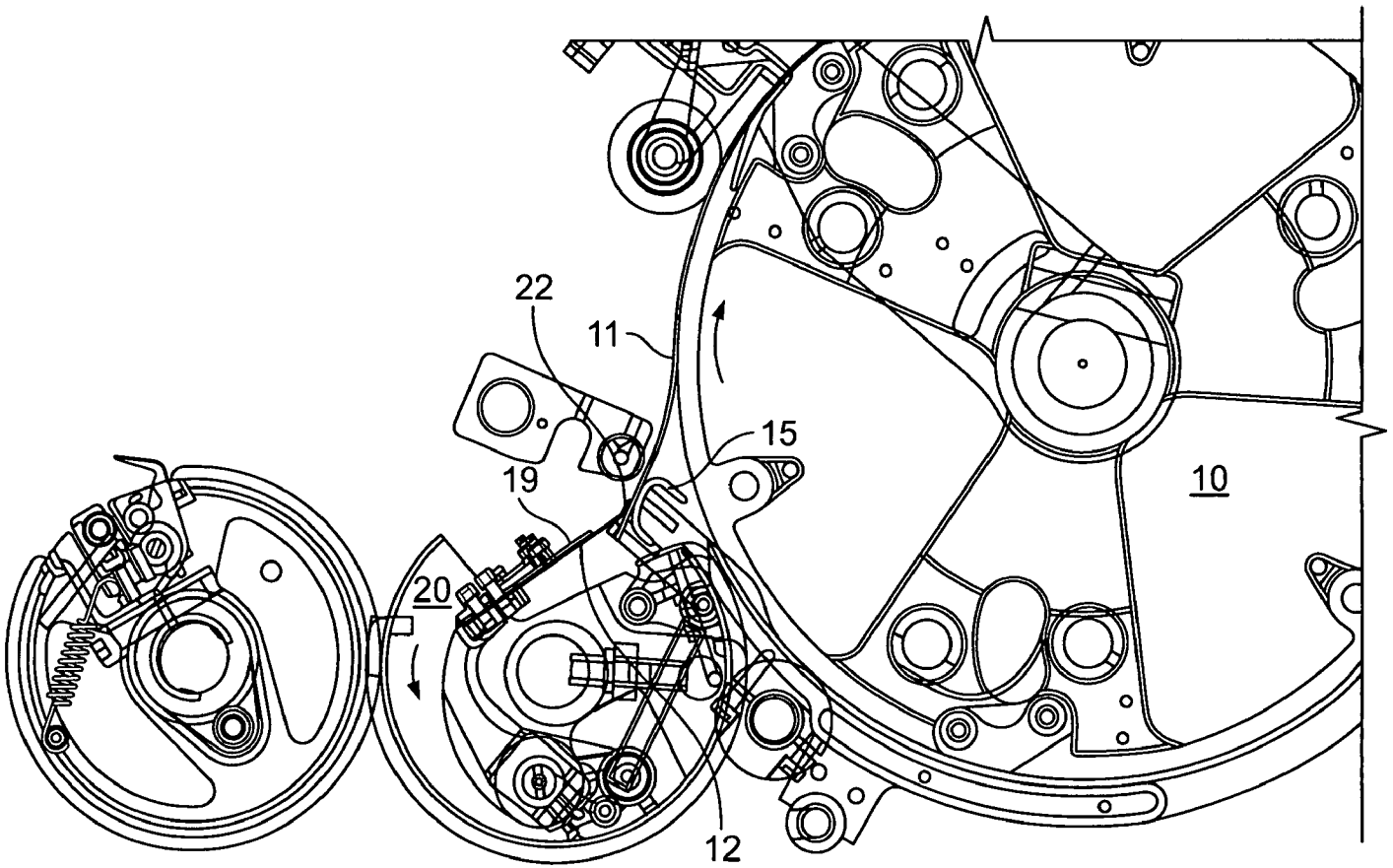
FIG. 4 shows the signature hopper as in FIG. 3 at a further time point.

FIG. 4 shows primary gripper 12 closing on signature 11. Second drum 20 continues rotating in the counterclockwise direction and primary gripper 12 continues closing. As primary gripper 12 closes, dipper blade 15 continues to contact and support signature 11. Thus, signature 11 is fed into primary gripper 12 via dipper blade 15 as first drum 10 and second drum 20 rotate.

Figure 5:
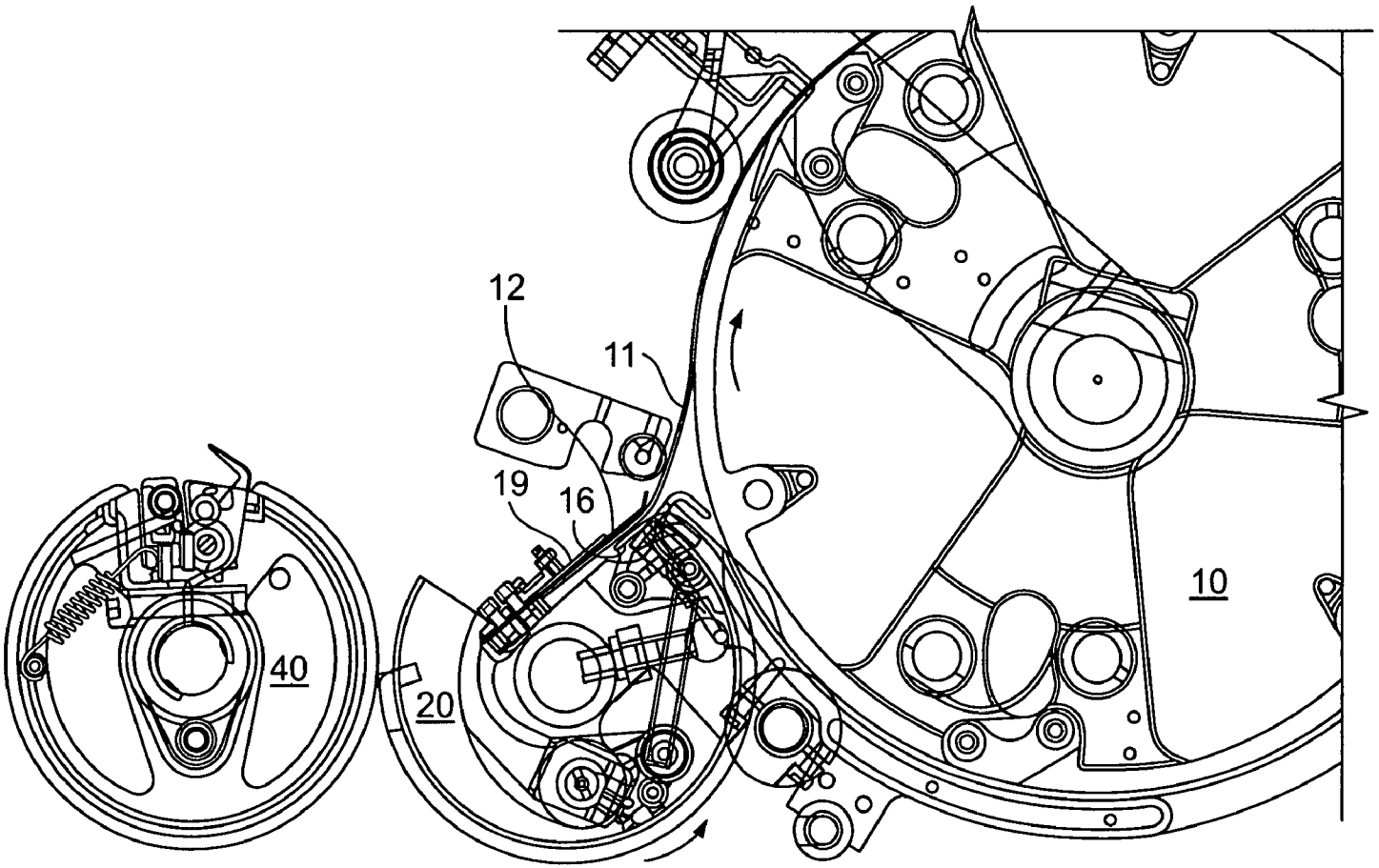
FIG. 5 shows the signature hopper as in FIG. 3 with the second drum gripping the signature.

FIG. 5 shows second drum 20 gripping signature 11 via primary gripper 12, which closes against gripper seat 16. Thus, second drum 20 grips signature 11 by primary gripper 12 against the gripper seat 16, with lap gripper 19 gripping the longer or lapped edge of the signature only. (FIG. 4) A third drum 40 can then receive the gripped signature from drum 20, and transfer it to a saddle conveyor of a saddle stitcher.

Figure 6:
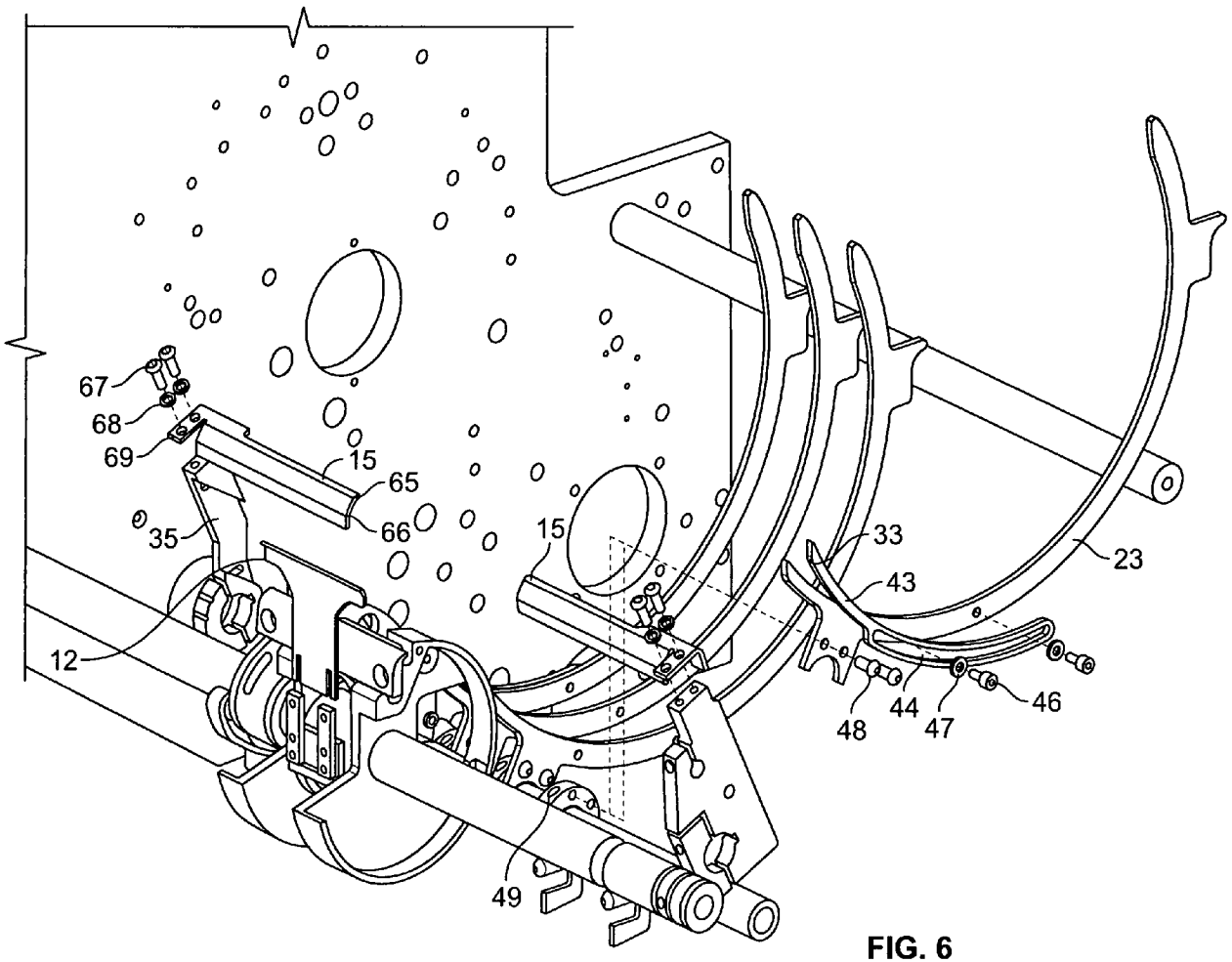
FIG. 6 shows an exploded perspective view of parts of the signature hopper according to the present invention.

FIG. 6 shows an exploded view and the retrofitting of an existing GOSS SP-1100 saddle stitcher. For the four signature supports 23 and extension 43 may be added via bolts 46 and washers 47 through a curved slot 45 of the extension 43. This arrangement advantageously also permits variability of the angular position of end 33. The support 23 is attached via screws 48 for example to a collar 49.

Dipper blades 15 have two bends 65, 66 to provide the advantageous curved profile, and enter the first drum 10 from the ends. The dipper blades 15 are attached via screws 67 and washers 68 and holes 69 to a support 35.

Figure 6A:
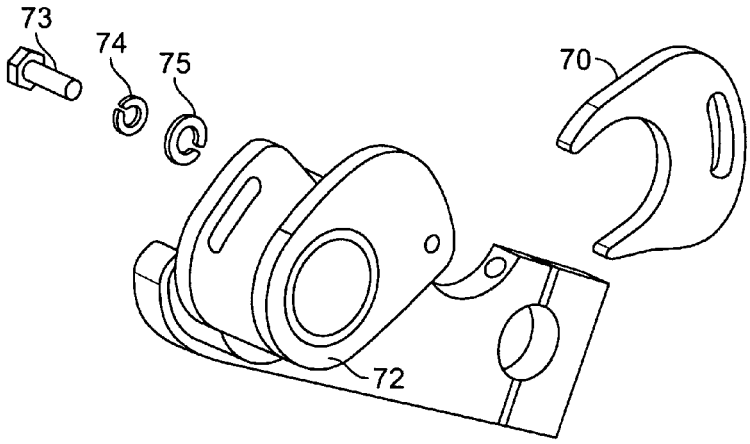
FIG. 6A shows a cam for the gripper of the second drum.
Figure 6B:
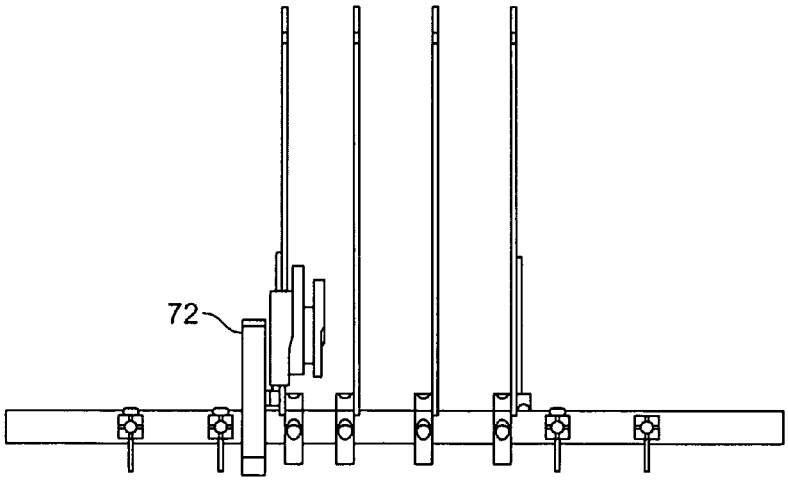
FIG. 6B shows an end view of the cam and a section of the gripper for the second drum.

As shown in FIG. 6A, cam mask 70 can fit over an existing cam of the cam 72 for the primary gripper 12 to cause the gripper 12 to close more quickly, and can be attached via a screw 73 and lock washer 74 and washer 75. The cam arm can be moved for example 0.25 inches towards a stitcher end to aid the gripper movement, as per FIG. 6B.

What is claimed is:

1. A signature hopper comprising:

a first drum having a first gripper for a lead edge of a folded signature;

a second drum having a second gripper for an open edge of the folded signature, the second gripper having a gripper finger with an end curled in a direction of rotation of the second drum;

a dipper blade mounted on a fixed pivotable axis adjacent to the first and second drums, the dipper blade pushing the open edge from the first drum toward the gripper finger as the signature contacts the end of the gripper finger; and a stationary signature guide spaced with respect to the first drum, the signature contacting the signature guide as the first drum rotates the signature past the signature guide, the signature guide having an adjustable end in a direction of rotation of the first drum circumferentially spaced from the dipper blade by an angle, the end of the signature guide being adjustable circumferentially to set the angle.

2. A saddle stitcher comprising a plurality of the signature hoppers as recited in claim 1, a saddle conveyor and a stitcher.

3. The signature hopper recited in claim 1 wherein the first drum is rotatable in a first direction about a first drum axis and the second drum is rotatable in a second direction opposite the first direction about a second drum axis.

4. The signature hopper recited in claim 1 further comprising a support arm coupling the dipper blade to the pivotable fixed axis.

5. The signature hopper recited in claim 4 wherein the dipper blade is adapted to feed the signature into the gripper finger as the gripper finger closes.

6. The signature hopper recited in claim 4 wherein the dipper blade is adapted to push the signature against the gripper finger as the second drum rotates.

7. The signature hopper recited in claim 4 wherein the dipper blade is configured to push the signature against the gripper finger as the gripper finger closes.

8. The signature hopper recited in claim 1 wherein the second drum further includes a lap gripper for gripping only the lapped edge of the signature as the gripper finger grips the signature.

9. The signature hopper recited in claim 1 wherein the dipper blade has a curved end facing away from the first rotational direction, the curved end pushing the open edge from the first drum toward the second drum until the signature contacts the end of the gripper finger.

10. The signature hopper recited in claim 1 further comprising a register stop for stopping a lead edge of the signature.

11. The signature hopper recited in claim 10 wherein in a direction of rotation of the first drum the adjustable end is circumferentially spaced from the register stop about the first drum so that the open edge of the signature remains in the signature guide or at the end when the signature hits the register stop.

12. A signature hopper comprising:

a first drum having a first gripper for a lead edge of a folded signature;

a second drum having a second gripper for an open edge of the folded signature, the second gripper having a gripper finger with an end curled in a direction of rotation of the second drum;

a dipper blade mounted on a fixed pivotable axis adjacent to the first and second drums, the dipper blade pushing the open edge from the first drum toward the gripper finger as the signature contacts the end of the gripper finger;

a stationary signature guide spaced with respect to the first drum, the signature contacting the signature guide as the first drum rotates the signature past the signature guide; and a register stop for stopping a lead edge of the signature wherein the signature guide has a section concentric with respect to the first drum, the section having an end point in a direction of rotation of the first drum circumferentially spaced from the register stop about the first drum so that the open edge of the signature remains in the signature guide or at the end point when the signature hits the register stop;

wherein the section of the signature guide is an extension section and the signature guide further includes a main section, the extension section being adjustably coupled to the main section to adjust the position of the end point with respect to an end of the dipper blade.

* * * * *